United States Patent [19]

Ozaki et al.

[11] 4,380,385

[45] Apr. 19, 1983

[54] METHOD OF TRANSFERRING TONER POWDER IMAGE BY PRESSURE AND APPARATUS THEREFOR

[75] Inventors: Yoshihiro Ozaki, Isehara; Shuichiro Kaneko, Mitaka; Masayuki Kuniyoshi, Sagamihara; Shoji Kondo, Tokyo; Yasukuni Omata, Hachioji, all of Japan

[73] Assignee: Minolta Camera Kabushiki Kaisha, Osaka, Japan

[21] Appl. No.: 228,806

[22] Filed: Jan. 27, 1981

[30] Foreign Application Priority Data

Feb. 18, 1980 [JP] Japan ..... 55-18875

[51] Int. Cl.[3] ..... G03G 15/16

[52] U.S. Cl. ..... 355/3 TR; 355/77; 430/126

[58] Field of Search ..... 355/3 TR, 3 R, 77; 430/126

[56] References Cited

U.S. PATENT DOCUMENTS 3,937,571 2/1976 Krulik et al. ..... 355/3 R
4,144,808 3/1979 Iwasa et al. ..... 355/3 TR
4,195,927 4/1980 Fotland et al. ..... 355/3 TR

FOREIGN PATENT DOCUMENTS 932788 8/1973 Canada ..... 355/3 TR
2102634 6/1972 Fed. Rep. of Germany ... 355/3 TR
2243732 7/1973 Fed. Rep. of Germany ... 355/3 TR

*Primary Examiner*—R. L. Moses
*Attorney, Agent, or Firm*—Wenderoth, Lind & Ponack

[57] ABSTRACT

The invention disclosed concerns a method and an apparatus for transferring a toner powder image from a toner image bearing member to a transfer paper by pressure. In transferring the toner image, a pressure roller is placed in contact with the surface of the toner image bearing member under a pressure of at least 20 kg/cm$^2$ and sliding is produced between the toner image bearing member and the transfer paper. Two different methods can be used to produce the sliding. The first method is to rotate the pressure roller at a speed different from the rotating speed of the toner image bearing member and the second method is to rotate the pressure roller so disposed to intersect its rotating axis with the rotating axis of the toner image member at an angle of about 0.5° to 2°.

8 Claims, 9 Drawing Figures

METHOD OF TRANSFERRING TONER POWDER IMAGE BY PRESSURE AND APPARATUS THEREFOR

BACKGROUND OF THE INVENTION

1. Field of the Invention

This invention relates to a method of transferring toner powder images by pressure and an apparatus therefor, and more particularly to a method and an apparatus for use in transfer-type copying machines, electrostatic printers, etc. for pressure-transferring an electrostatic image developed with a toner powder.

2. Description of the Prior Art

With copying machines of the transfer type, a uniformly charged photoconductive member is exposed to the optical image of an original to form thereon a latent electrostatic image, which is developed and then transferred onto plain paper. With electrostatic printers, the desired latent electrostatic image is formed on a dielectric member by an electrostatic recording head, and the image is developed and thereafter transferred onto paper. The apparatus of either type usually use a two-component toner for development, such that the toner is charged to a polarity opposite to that of the latent image and then deposited on the image to obtain a toner image, which is subsequently transferred onto paper electrostatically.

The electrostatic transfer of the toner image is effected most generally by applying a voltage of opposite polarity to the toner to the rear side of the transfer paper by a corona charger or electroconductive transfer roller. This method, however, requires a large power supply means and has the drawback that copy images are not always available with high transfer efficiency and stability depending on the ambient conditions, especially humidity.

In recent years, transfer-type copying machines have been introduced into use which use a mono-component toner having magnetic and electroconductive properties, because difficulties are encountered with two-component toners in maintaining the toner and the carrier in a constant ratio and also because the carrier is liable to cling to the latent image. A copying machine of this type, still resorting to electrostatic transfer, fails to assure a stable transfer operation. Additionally, the toner, which has no polarity in itself, requires a very complex electrostatic transfer system.

In view of the foregoing situation, a method has been proposed as in U.S. Pat. No. 3,937,571 in which toner images are transferred by pressure without using electrostatic attraction and which is almost free of the influence due to the ambient conditions. According to the pressure transfer method, a transfer material is passed between the surface of a toner image bearing member and a pressure roller pressed against the surface under a predetermined pressure. Although this method is almost unaffected by variations in the ambient conditions as mentioned above and can be practiced with a simple apparatus without requiring any electrical means, the method is considerably lower in transfer efficiency than usual electrostatic transfer methods and is unable to afford satisfactory copy images. To overcome the drawback, it appears useful to set the pressure roller at a higher pressure, but the toner image bearing member will then have a seriously shortened life, especially when the bearing member is a photoconductive member. Alternatively a toner may be used which can be transferred properly at a low pressure. However, this requires complicated transfer conditions and also poses a great limitation on the kinds of toners usable.

SUMMARY OF THE INVENTION

Accordingly, the main object of the present invention is to provide a novel and improved method of transferring toner powder images by pressure with high efficiency to obtain satisfactory copy images and an apparatus therefor.

Another object of the invention is to provide a method of transferring toner powder images by pressure which method is not particularly limited in the kind of toners usable and can be practiced even at a relatively low pressure and also under widely varying conditions.

Still another object of the invention is to provide an apparatus of simple construction for transferring toner powder images efficiently.

This invention provides a method of transferring a toner image from a toner image bearing member onto a transfer material by pressure, characterized in that sliding or slippage is produced between the bearing member and the transfer material during the transfer of the toner image. More specifically, the method of the present invention is characterized in that sliding is produced between the bearing member and the transfer material in an amount of at least about 0.67% of the length of the transfer material under a pressure of at least 20 kg/cm$^2$ applied to the surface of the bearing member, thereby the toner image is transferred onto the transfer material satisfactorily with high efficiency. The invention also provides an apparatus for this method.

For a fuller understanding of the nature and objects of the present invention, reference is made to the following detailed description taken in conjunction with the accompanying drawings.

DESCRIPTION OF THE PREFERRED EMBODIMENTS

Figure 1:
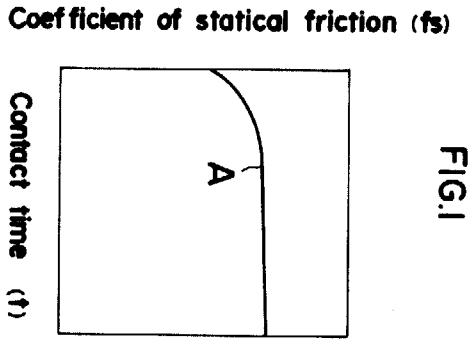
FIGS. 1 and 2 are diagrams generally showing the mechanism of sliding friction, FIG. 1 being a graph showing the relation between the coefficient of static friction and contact time, FIG. 2 being a graph showing the relation between the coefficient of kinetic friction and sliding speed.

According to the present invention, sliding is produced between a toner image bearing member and a transfer material during the pressure transfer of a toner image. As a first method, the sliding per se is produced by creating a difference in surface speed between a pressure roller serving as the transfer means and the toner image bearing member, preferably by transporting the transfer material at a constant speed and driving the bearing member at a surface speed higher or lower than the speed of the transfer material. This will be described more specifically with reference to a transfer copying machine of the slit exposure type. When the photoconductive member of the machine is driven at a surface speed lower than a constant speed at which transfer paper is transported, an image contracted or diminished in the direction of motion of the photoconductive member is formed thereon owing to the speed difference. In other words, when the original scanning means and the transfer paper are driven at the same speed and the photoconductive member, for example, at 0.8 times the speed, the image formed on the member is contracted in the direction of motion thereof to a size 0.8 times the original. The image is then developed with a toner powder and transferred to the paper by pressure. Since the transfer paper moves at 1.25 times the speed of the photoconductive member at this time, sliding occurs between the member and the paper in the feeding direction of the paper, acting to enlarge the toner image, with the result that a toner image of the same size as the original image is transferred to the paper. Similarly, when the photoconductive member is driven at a higher speed, an enlarged image is formed, which is contracted to the same size as the original image when transferred by pressure. While the mechanism of pressure transfer by the above method of sliding will be described later, the amount of sliding between the bearing member and the transfer material is preferably at least about 0.67% and can be up to about 27% of the length of the transfer material (this means about 1/150th to 4/15th the length of the transfer material), because if it is less than about 0.67%, high transfer efficiency is not attainable, whereas if it is more than about 27%, copy images will not be available with a high quality free from disturbances in spite of high transfer efficiency. In other words, if the length of the transfer material is 300 mm which is same size as the original to be copied, the amount of sliding should be at least about 2 mm and can be up to about 80 mm. Similarly, if the length of the transfer material in the feeding direction is 500 mm, the amount of sliding should be about 3.3 mm to 133 mm. For the same reason, the amount of sliding should be about 1.33 mm to 53.3 mm if the length of the transfer material is 200 mm.

Sliding can be produced between the toner image bearing member and the transfer material by a second method, that is, by causing the pressure roller serving as the transfer means to intersect the rotary shaft of the toner image bearing member at a small angle. The pressure roller is arranged in a driven relation to the bearing member. Preferably the angle of intersection is about 0.5° to about 2.0°. The intersecting arrangement of the pressure roller produces sliding between the bearing member and the transfer material along the rotary shaft, i.e. laterally, during transfer. Since an obliquely distorted transferred image will result from this arrangement, the distortion must be corrected in advance by the original scanning means or optical system in the case of transfer copying machines, while with electrostatic printers, deformed latent images should be formed which, when transferred, will give correct images free of any distortion. When the pressure roller has an angle of intersection of about 0.5° to about 2.0°, the amount of sliding is about 0.87% to 3.5% of the length of the transfer material. This means if the length of the transfer material is 300 mm, the amount of sliding is about 2.6, to about 10.5 mm. It should however be noted that this sliding is produced laterally, i.e., parallel to the rotary shaft of the photoconductive member. If the angle is less than 0.5°, reduced transfer efficiency will result, whereas at angles exceeding 2°, the transfer material will wrinkle although high transfer efficiency is achievable.

The pressure roller serving as the transfer means will now be described. The pressure roller comprises a roll-shaped metal core and a covering formed over the surface of the core and having a modulus of elasticity preferably of at least about 10 kg/mm$^2$. The pressure roller is adapted to press the toner image bearing member to exert a pressure of at least about 20 kg/cm$^2$ on the surface of the bearing member. Thus the surface covering should preferably have a modulus of elasticity of at least about 10 kg/mm$^2$ because if the covering is less than about 10 kg/mm$^2$ in the modulus, the covering, when pressed against the image bearing surface, provides a nip of fairly large width to pressure the surface over a wide area, consequently requiring a high pressure to give the specified pressure per unit area of pressing contact. The arrangement then becomes very complex and fails to assure satisfactory image transfer, while the covering itself is subject to permanent deformation earlier. The upper limit of the modulus of elasticity is not particularly defined. Examples of useful materials for the covering are aluminum, anodically oxidized aluminum, etc., in which case the metal core itself can serve also as the surface covering.

The material for the surface covering is not particularly limited, provides that it has a modulus of elasticity not lower than the above-mentioned value. Examples of other suitable materials are polyethylene, polyfluoroethylene propylene, polyamide resin, polyurethane, polyacetal, polyvinyl chloride, phenol, aluminum, etc.

The transfer roller, which presses the toner image bearing surface with transfer paper interposed therebetween, should apply a pressure of at least about 20 kg/cm$^2$ to the image bearing surface since the toner image will not be fully transferred at lower pressures. The upper limit of the pressure, which is dependent on the material of the image bearing member, the material of the transfer roller, etc., is preferably not higher than about 200 kg/cm$^2$ for usual purposes. Higher pressures impair the strength of the bearing member as well as of the transfer roller although satisfactory transfer may be effected.

While the foregoing first and second methods will be described furter with respect to the mechanism of transfer by the sliding between the photoconductive member and the transfer material, the mechanism of sliding friction will be explained first generally.

When one solid body is about to slide over another, a frictional force generally acts between the opposed surfaces in parallel thereto. Accordingly no sliding occurs unless the sliding force overcomes the frictional force. The origin of the frictional force is explained by "adhesion—plowing theory".

The theory of adhesion is that the frictional force is a force for shearing the contact portion between the surface of solid bodies in contact. The plowing theory is that when one body slides on another, a force (plowing resistance) is needed for working its way through the "engagement" between the opposed surfaces of the bodies, which is dependent on the geometric configurations, namely the surface roughnesses, of the bodies.

According to the "adhesion—plowing theory," the frictional force F is given by $$F=Fa+Fb$$

where Fa is the frictional force due to adhesion, and Fb is the plowing resistance. Since Fa is much greater than Fb for usual smooth surfaces, it is thought that the frictional force is chiefly a force for shearing the adhered portion.

Suppose the shearing strength of the adhered portion is S, and the true contact area is A, Fa is given by $$Fa=SA$$

Usually two bodies, when in contact with each other, are plastically deformed at and near the location of true contact due to the local concentration of load. Accordingly there is the following relation.

$$A=P/H$$

where H is the hardness of the bodies, and P is the entire load acting between the bodies.

Since the coefficient of friction $\mu$ is defined as a value obtained by dividing the frictional force F (which is assumed to be approximate to Fa) by the load P, $$\mu=Fa/P$$

The combination of this equation with the preceding two equation gives $$\mu=S/H \quad (1)$$

The following three empirical laws of friction are known as Coulomb's laws or Amontons' laws. The coefficient of friction is (1) independent of the load, (2) independent of the velocity of sliding, and (3) independent of the apparent area of contact. It will be understood that these empirical laws can be well explained by Equation (1).

However, these empirical laws do not always hold true in practice. The velocity independence law, especially, does not hold true at low velocities as will be apparent from the fact that the empirical law further teaches that the coefficient of static friction is greater than that of kinetic friction. This law nevertheless is valid generally over the range of observable velocities in which the coefficient of friction varies only several percent when the velocity varies 10 times or more.

Figure 2:
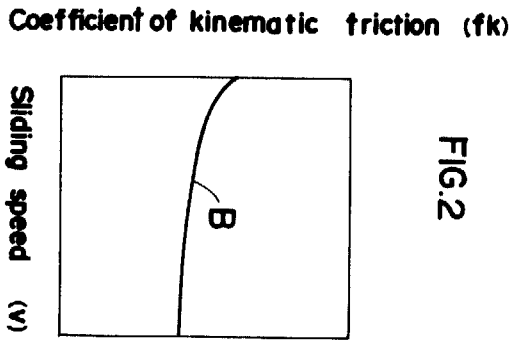

In discussing the influence of sliding in pressure transfer, the difference between static friction and kinetic friction must be taken into account. This will be described with reference to FIGS. 1 and 2. FIG. 1 shows the relation between the coefficient of static friction fs and the content time t. Curve A satisfies the equation $$fs=fo+kt^{1/10}$$

in which fo and k are constants obtainable from experiments. FIG. 2 shows the relation between the coefficient of kinematic friction fk and the velocity of sliding v. Curve B satisfies the equation $$fk=cv^{-1/10}$$

where c is a constant also obtainable from experiments.

FIG. 1 reveals that the coefficient of static friction fs varies with the contact time t and increases with increasing contact time. A comparison of FIG. 1 with FIG. 2 showing the relation of the coefficient of kinematic friction fk with the velocity $\mu$ indicates that the relation between the coefficient of static friction and that of kinematic friction can be explained in terms of the difference in the contact time. As shown in FIG. 1, the coefficient of static friction fs markedly increases for a very short period of contact time but increases only slightly during the subsequent period of contact time. Conversely FIG. 2 indicates that the coefficient of kinematic friction fk decreases with increasing velocity. Accordingly the force of static friction is greater than that of sliding friction and is generally about twice the latter.

The mechanism of the first method of sliding transfer effected by a difference in velocity between the transfer material and the toner image bearing member will be described below based on the mechanism of sliding friction described above.

Suppose a toner powder is sandwiched between the image bearing member and the transfer material under pressure. Assuming that the toner is softer than the bearing member and the transfer material, the area of contact between the toner and the bearing member is equal to that between the toner and the transfer material. When the bearing member and the transfer material are moved in parallel with a given difference between their velocities, a frictional force acts between each pair of opposed surfaces to deform the toner particles. In the interior of the toner particles, a stress occurs which deforms the particles in a direction opposite to that of the frictional force although no sliding takes place in this state. As the displacement of the transfer material relative to the bearing member further increases, the stress due to the deformation of the toner particles exceeds the frictional force between either pair of the opposed surfaces, causing sliding between that pair of opposed surfaces. With the start of sliding, the frictional force decreases as shown in FIG. 2, with the result that the toner somewhat restores itself from deformation with its stress in equilibrium with the sliding friction. The phenomenon that the frictional force decreases with the start of sliding means that the adhering force between the opposed surfaces decreases, so that the toner adheres to the surface which is at rest at this time.

Figure 3:
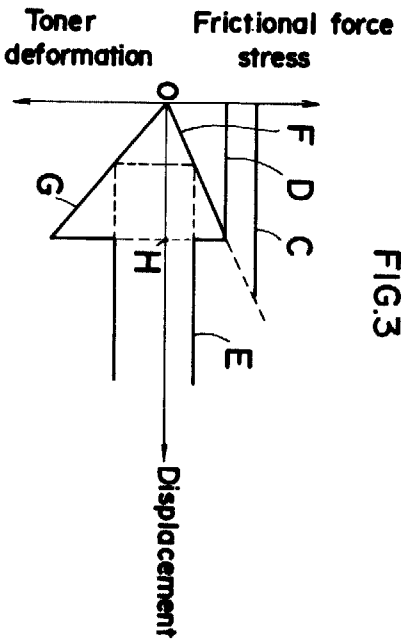
FIGS. 3 and 4 are graphs showing the mechanism of pressure transfer of this invention effected by sliding.

The above relation is illustrated in FIG. 3, in which the displacement between the transfer material and the bearing member is plotted on the abscissa, the frictional force and the stress of the toner on the upper ordinate, and the deformation of the toner on the lower ordinate. The force of static friction between the toner and the transfer material is represented by Solid Line C, the force of static friction between the toner and the bearing member by Line D, the force of kinetic friction between the toner and the bearing member by Line E, the stress of the toner by Line F, and the amount of deformation of the toner by Line G. For simplicity, it is assumed that the toner deforms elastically. Thus the toner deforms in proportion to the stress. FIG. 3 shows that at a point H of displacement, the static friction force D between the toner and the bearing member is exceeded by the stress F of the toner, permitting the toner to start sliding on the bearing member with a reduced frictional force. The stress of the toner comes into equilibrium with the frictional force, reducing the deformation of the toner. Thus the toner, when sliding in a pressed state, slides on the bearing member.

Figure 4:
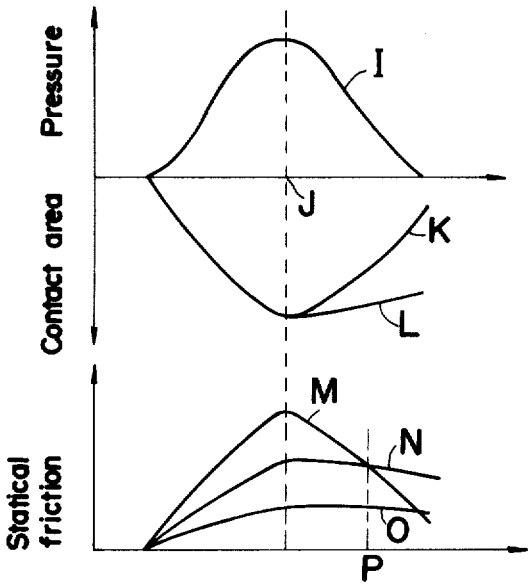

FIG. 4 shows the pressure, the area of contact and the force of static friction involved in actual pressure transfer and determined with the lapse of time. With reference to FIG. 4, Curve I represents variations in the pressure applied by a pressure roller serving as the transfer means, during the application of the pressure from start to end. The pressure is at the highest level at the midpoint J. Curve K represents variations in the area of contact between the transfer material and the toner will variations in the pressure, Curve L similarly varying areas of contact between the bearing member and the toner, Curve m variations in the force of static friction between the transfer material and the toner, and Curve N variations in the force of static friction between the bearing member and the toner. Curve O represents variations in the static friction force between the bearing member and the toner when a lubricant is applied to the surface of the bearing member to reduce the friction force as will be described later. FIG. 4 reveals that up to the maximum point J of the pressure, i.e., the center of the nip, the friction forces M and N increase in accordance with the coefficients of friction between the opposed surfaces of the bearing member and the toner, and the toner and the transfer material, respectively. Beyond the point J, however, the area of contact, K, between the surfaces of the transfer material and the toner decreases greatly owing to a reduction in the stress, also entailing a reduction in the friction force M. On the other hand, the area of contact, L, between the surfaces of the bearing member and the toner decreases to a lesser extent with a lesser reduction in the friction force N. The friction force N exceeds the friction force M for the first time at a point P. Accordingly if sliding occurs between the bearing member and the transfer material somewhere between the point P and the end point of pressure application, this sliding takes place chiefly between the transfer material and the toner, resulting in faulty transfer of the toner.

The toner can be transferred properly under such condition that sliding occurs to complete the transfer before the point P. When a lubricant is applied to the bearing member to mitigate the force of friction involved, the friction force represented by Curve O will be produced between the bearing member and the toner, consequently enlarging the transferable range to the end point of pressure application to eliminate the faulty transfer mentioned above. The means for applying the lubricant will be described later specifically.

The mechanism of transfer by the second method of causing sliding between the transfer material and the bearing member, that is, by causing the pressure roller to intersect the axis of the bearing member is based on the same principle as already described with reference to FIG. 4 and will not be described further although different in detail, i.e., in that sliding occurs laterally. With the second method, it is critical to position the pressure roller at an angle of intersection of about 0.5° to about 2° and to select the material of the surface covering of the pressure roller so that no sliding takes place between the pressure roller and the transfer material.

A detailed description will now be given of a copying machine for practicing the method of this invention for transferring toner images by pressure.

Figure 5:
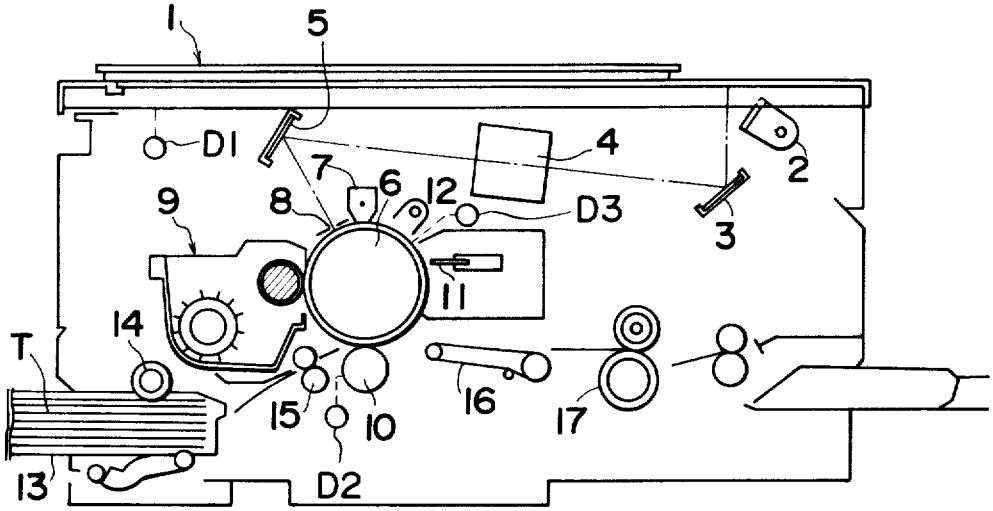
FIG. 5 is a diagram in section showing an electrophotographic copying machine for practicing the pressure transfer method of this invention.

FIG. 5 is a diagram showing a transfer copying machine of the slit exposure type in its entirety. Indicated at 1 is a reciprocatingly movable document carriage which carries thereon an original, the image of which is illuminated with an exposure lamp 2. By means of a first mirror 3, a lens 4 and a second mirror 5, the image is successively projected on a photoconductive drum 6 serving as the toner image bearing member. Arranged around the drum 6 in the direction of rotation thereof are a sensitizing corona charger 7, an exposure slit 8, a magnetic brush developing unit 9, a pressure roller 10 serving as the transfer means, a blade cleaner 11 and an eraser lamp 12. Transfer paper T is placed in a cassette 13 and sent out one sheet after another by a feed roller 14. The paper T is fed by rollers 15 to the nip of the pressure roller 10 and the photoconductive drum 6. After a toner image is transferred to the paper T by pressure, the paper is fed by a conveyor belt 16 to a heat roller 17, by which the toner image is fixed. The paper is thereafter discharged from the machine.

As already described, the pressure roller 10 comprises a roll-shaped metal core with its surface covered to a uniform thickness with a material having a modulus of elasticity of at least about 10 kg/mm$^2$. The pressure roller 10 is arranged to exert a pressure of about 20 to about 200 kg/cm$^2$ on the surface of the photoconductive drum 6 when the transfer paper T passes between the roller 10 and the drum 6. When the foregoing first method is used for pressure transfer, the scanning speed of the document carriage 1 is made equal to the speed of transport of the transfer paper by the pressure roller 10 for life-size copying by suitable drive means D1 and D2, with the drum 6 driven at a higher or lower speed by another drive means D3. The scanning speed of the document carriage 1 may of course be made higher or lower than the speed of rotation of the drum to obtain life-size toner images on transfer. Accordingly the drum 6 and the pressure roller 10 are adapted to be driven independently of each other. When the transfer is effected by the first method of sliding, the pressure roller 10 may preferably be crowned to give the roller 10 the largest radius at the center and a progressively decreasing radius toward the ends, whereby the drum 6 can be subjected to a uniform pressure on its surface.

Figure 6:
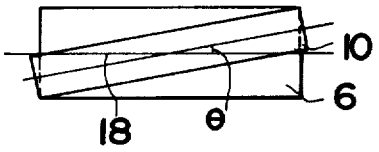
FIG. 6 is a diagram showing the arrangement of pressure transfer means.

When the second method of pressure transfer is resorted to, the pressure roller 10 is disposed with its center axis intersecting the axis 18 of the drum 6 at an angle $\theta$ of about 0.5° to about 2° as shown in FIG. 6. Since lateral sliding, i.e., sliding parallel to the axis 18 of the drum 6 is produced between the transfer paper and the drum 6 only by this arrangement, it is most preferable that the pressure roller 10 itself be driven by the movement of the drum 6. The intersecting arrangement produces a distorted image upon transfer, so that a distorted latent image is formed in advance on the drum for the correction of the distortion, by deflecting the lens sideways during the scanning of the original image or by moving the scanning means itself in both X and Y directions.

Figure 7:
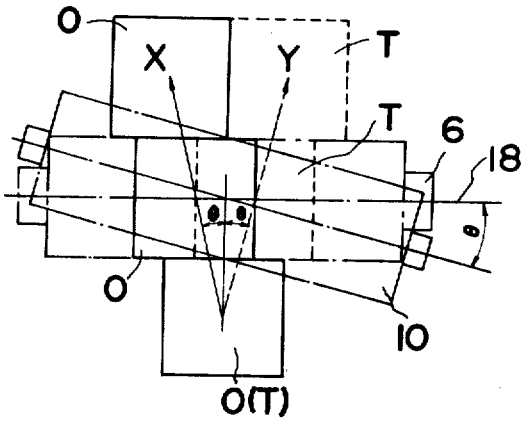
FIG. 7 is a diagram showing the relation of feeding directions of an original and a transfer material when the pressure transfer means of FIG. 6 is used.

This will be explained more in detail with reference to FIG. 7 in which the original carried by the document carriage is moved obliquely. To form an image of the original O on the photoconductive drum 6, the original O is moved obliquely in the direction of X (solid line arrow) which forms an angle $\theta$ relative an imaginary line perpendicular to the axis 18 of the drum 6. Needless to say, this angle $\theta$ is identical with the angle formed by the intersection of the pressure roller 10 relative to the axis 18 of the drum 6. It is to be noted that the original O should be moved to enable its leading edge to be always in parallel with the axis 18. The transfer paper T is fed through the nip between the photoconductive drum 6 and the pressure roller 10 in the direction of Y(dotted line arrow) which also forms an angle $\theta$ relative to the imaginary line perpendicular to the axis 18. As apparent, the direction X should be oblique toward the left as viewed in FIG. 7 if the direction Y is toward the right. By the above arrangement, an oblique image will be formed on the drum 6 which in turn will be corrected by the transfer so that the image corresponding to the original O will be formed on the transfer paper T.

In the foregoing explanation of the mechanisms of the first and second methods of producing sliding, it has been described that a lubricant, if applied uniformly to the surface of the image bearing member to reduce the frictional force, affords an increased transferable range for improved transfer efficiency. Devices for applying the lubricant will be described below in detail with reference to FIGS. 8 and 9.

Figure 8:
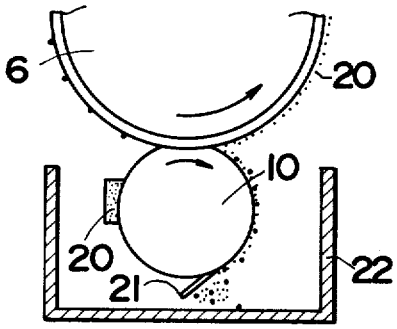
FIGS. 8 and 9 are diagrams showing means for applying a lubricant to the surface of a toner image bearing member to assure efficient transfer of toner images by pressure and sliding.

With the device shown in FIG. 8, the pressure roller 10 applies a solid lubricant 20 to the surface of the photoconductive drum 6, the roller 10 further functioning as the transfer means and also as a cleaner for removing residual toner. As illustrated, the lubricant 20 is held in contact with the surface of the pressure roller 10, whereby the lubricant is applied uniformly to the surface of the drum 6. As already stated, the lubricant 20 not only reduces the frictional force between the toner powder and the drum, giving a wider transferable range to effectively prevent improper transfer, but also prevents a filming phenomenon on the surface of the drum 6. Examples of suitable lubricants are phthalic acid, terephthalic acid, isophthalic acid, metal salts or ammonium salts of such acids, magnesium stearate, sodium stearate, zinc stearate, etc. Good results can be achieved by applying the lubricant 20 to the surface of the drum in an amount of about 1 to about 3 g per 10,000 copying cycles.

To render the pressure roller 10 serviceable as a lubricant applicator and also as a cleaner for removing the residual toner, the surface covering of the roller must be made of a soft material having a relatively low modulus of elasticity which is preferably up to 200 kg/mm$^2$, such as polyurethane, polyethylene, polyfluoroethylene propylene or the like. If the covering has a higher modulus of elasticity, the roller 10 fails to apply the lubricant 20 uniformly and to clean the drum effectively. While the pressure roller 10 applies the lubricant as described above, the residual toner is thereby removed efficiently, and the toner is then scraped off by a scraper 21 and collected in a recovery box 22. The lubricant 20 is not always held in contact with the surface of the pressure roller 10 but is moved away therefrom during transfer. Accordingly when the copying machine is so adapted that one copying cycle is completed through two revolutions of the drum 6, the device is controllable in such a simple manner that the toner image is transferred during the first revolution and the lubricant is applied to the drum during the second revolution.

Figure 9:
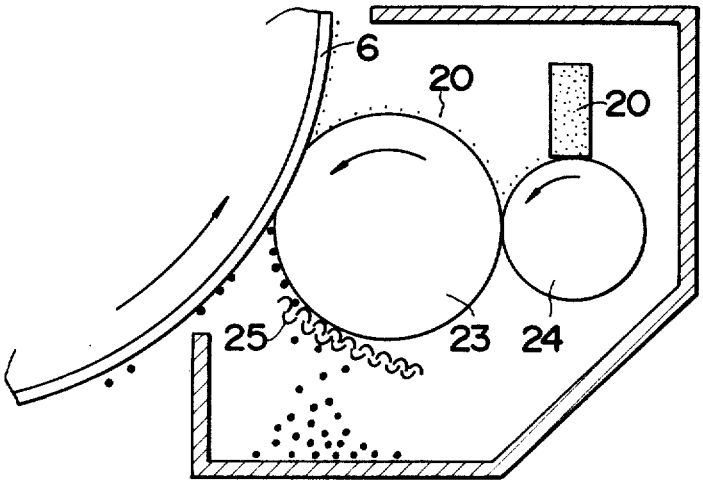

FIG. 9 shows another device for applying the lubricant. The blade cleaner 11 shown in FIG. 5 is replaced by a cleaning roller 23, which functions as a cleaner and also as a lubricant applicator. As shown the cleaning roller 23 is in contact with the surface of the photoconductive drum 6 and also with a lubricant feeding roller 24, which in turn is in contact with a lubricant 20. A screen 25 for removing residual toner from the cleaning roller 23 also prevents clogging of the roller 23. With this arrangement, the lubricant is applied uniformly to the surface of the drum 6 by means of the feeding roller 24 and the cleaning roller 23.

The pressure transfer method of this invention will be described with reference to the following experimental examples.

Experimental Example 1

A copying machine having the construction of FIG. 5 was used. The photoconductive drum 6 was prepared by formulating a dispersion from a photo- and electroconductive powder of $CdS.nCdCO_3$ ($0<n\leqq 4$), thermosetting acrylic resin and solvent, applying the dispersion to an aluminum substrate, 80 mm in diameter and 30 cm in length, to a thickness of about 30$\mu$, and thermally curing the coating. The pressure roller 10 had a hollow cylindrical aluminum core measuring 20 mm in diameter and 30 cm in length, having a maximum outside diameter at the center and tapered to a progressively decreasing diameter toward its opposite ends, and a surface covering of polyurethane having a modulus of elasticity of about 20 to about 30 kg/mm$^2$ (rubber hardness 97°).

The pressure roller was disposed in opposed relation to the drum and driven independently of the drum. The drum was driven at successively varying surface speeds such that the amounts of sliding between the drum and the transfer paper would be 0 mm to 90 mm, and the transfer efficiencies achieved were measured. In other words, the transfer paper was transported by the pressure roller at the same speed as the document carriage, while the drum was driven at varying surface speeds of from the same speed to lower speeds. Two kinds of toners were used, one for heat fixing (product of MINOLTA CAMERA KABUSHIKI KAISHA known as "EP-310") and the other for pressure fixing (product of MINOLTA known as "EG-301"). The transfer efficiency was calculated by dividing the weight of toner transferred onto the transfer paper by the weight of toner required for developing the latent image, and multiplying the quotient by 100 (%). Varying pressures of 10 kg/cm$^2$, 20 kg/cm$^2$, 30 kg/cm$^2$ and 50 kg/cm$^2$ were applied to the surface of the drum. Thus a toner image was transferred four times unde the same conditions to determine the transfer efficiency at each pressure. Wood-free paper, 300 mm in length, was used as the transfer paper. The results are listed in Tables 1 to 8.

In Tables 1 to 8, the first column shows the amount of sliding (mm) between the drum and the transfer paper per 300-mm length of the paper, the second column shows the pressure (kg/cm$^2$) applied to the drum surface for the transfer, the third column "A" indicates the heat fixing toner and "B" the pressure fixing toner, and the fourth column shows the transfer efficiency (%).

TABLE 1

| Amount of sliding | Pressure | Toner | Transfer efficiency |
|---|---|---|---|
| 0 | 10 | A | 30 |
| | | B | 5 |
| | 20 | A | 65 |
| | | B | 20 |
| | 30 | A | 70 |
| | | B | 25 |
| | 50 | A | 85 |
| | | B | 30 |

TABLE 2

| Amount of sliding | Pressure | Toner | Transfer efficiency |
|---|---|---|---|
| 2.0 | 10 | A | 40 |
| | | B | 65 |
| | 20 | A | 60 |
| | | B | 75 |
| | 30 | A | 75 |
| | | B | 80 |
| | 50 | A | 85 |
| | | B | 85 |

TABLE 3

| Amount of sliding | Pressure | Toner | Transfer efficiency |
|---|---|---|---|
| 3.3 | 10 | A | 50 |
| | | B | 65 |
| | 20 | A | 75 |
| | | B | 80 |
| | 30 | A | 80 |
| | | B | 85 |
| | 50 | A | 90 |
| | | B | 90 |

TABLE 4

| Amount of sliding | Pressure | Toner | Transfer efficiency |
|---|---|---|---|
| 10 | 10 | A | 50 |
| | | B | 65 |
| | 20 | A | 75 |
| | | B | 80 |
| | 30 | A | 80 |
| | | B | 85 |
| | 50 | A | 90 |
| | | B | 90 |

TABLE 5

| Amount of sliding | Pressure | Toner | Transfer efficiency |
|---|---|---|---|
| 20 | 10 | A | 50 |
| | | B | 60 |
| | 20 | A | 75 |
| | | B | 85 |
| | 30 | A | 85 |
| | | B | 85 |
| | 50 | A | 90 |
| | | B | 95 |

TABLE 6

| Amount of sliding | Pressure | Toner | Transfer efficiency |
|---|---|---|---|
| 35 | 10 | A | 55 |
| | | B | 60 |
| | 20 | A | 80 |
| | | B | 80 |
| | 30 | A | 85 |
| | | B | 90 |
| | 50 | A | 90 |
| | | B | 90 |

TABLE 7

| Amount of sliding | Pressure | Toner | Transfer efficiency |
|---|---|---|---|
| 50 | 10 | A | 55 |
| | | B | 60 |
| | 20 | A | 80 |
| | | B | 80 |
| | 30 | A | 85 |
| | | B | 90 |
| | 50 | A | 90 |
| | | B | 95 |

TABLE 8

| Amount of sliding | Pressure | Toner | Transfer efficiency |
|---|---|---|---|
| 90 | 10 | A | 55 |
| | | B | 60 |
| | 20 | A | 80 |
| | | B | 80 |
| | 30 | A | 85 |
| | | B | 90 |
| | 50 | A | 90 |
| | | B | 90 |

The results listed above indicate that the application of the pressure of 10 kg/cm$^2$ attained poor transfer efficiencies in all cases irrespective of the amount of sliding, the highest efficiency being as low as 65% with the use of the toner B. In view of the fact that transfer efficiencies of at least 75 to 80% are generally required for giving useful toner images, the pressure of about 10 kg/cm$^2$ proves to be too low to effect satisfactory transfer. In this respect, the pressure of 20 kg/cm$^2$ generally achieved transfer efficiencies of 75 to 85% with a few exceptions, thus substantiating the necessity of applying a pressure of at least about 20 kg/cm$^2$.

However, the transfer efficiency is more largely dependent on whether or not sliding is produced than on the pressure setting, as will be apparent especially from a comparison between Tables 1 and 2. Stated more specifically, when the transfer paper and the drum were driven at the same speed for pressure transfer in the conventional manner without producing any sliding, the transfer efficiencies attained were all less than 75% except when the toner A was used at a pressure of 50 kg/cm$^2$. In the case where the pressure fixing toner B was used, even the highest efficiency was as low as 30%. However, with a sliding amount of 2 mm per 300-mm length of the transfer paper, remarkably improved transfer efficiencies of at least 75% were attained with copy images of outstanding quality, except when the toner A was used at a pressure of 20 kg/cm$^2$. Thus sliding is highly effective in improving the transfer efficiency and the quality of transferred toner images.

The results listed in Tables 3 to 8 also support the effect of sliding. With a sliding amount of up to 90 mm and a pressure of at least 20 kg/cm$^2$, the transfer efficiency was at least 75% each case and was 95% when highest. On the other hand, the copy images obtained with a sliding amount of up to 50 mm were found to have a high quality, whereas transfer with a sliding amount of 90 mm resulted in copy images of slightly impaired quality. This indicates that the amount of sliding should be limited to about 70 to 80 mm. In other words, the amount of sliding should be as small as about 0.67% and can be large as about 23 to 27% of the length of transfer paper. The pressure may be more than 50 kg/cm$^2$ and can be up to 200 kg/cm$^2$. In this case, about 5% improvement is achievable in the transfer efficiency on the average. Preferably the pressure should not exceed 200 kg/cm$^2$ since higher pressures will shorten the life of the photoconductive member.

Experimental Example 2

The procedure of Experimental Example 1 with a sliding of amount of 10 mm was repeated under the same conditions except that a lubricant was uniformly applied to the surface of the photoconductive drum 6. The lubricant used was a solid piece of magnesium stearate prepared by a press. Table 9 shows the results.

TABLE 9

| Amount of sliding | Pressure | Toner | Transfer efficiency |
|---|---|---|---|
| 10 | 10 | A | 55 |
| | | B | 65 |
| | 20 | A | 80 |
| | | B | 80 |
| | 30 | A | 85 |
| | | B | 85 |
| | 50 | A | 90 |
| | | B | 95 |

The results of Table 9, when compared with those of Table 4 achieved without the application of any lubricant, reveal that improved transfer efficiencies were attained with use of the toner A at a pressure of 20 kg/cm$^2$, the toner A at a pressure of 30 kg/cm$^2$ and the toner B at a pressure of 50 kg/cm$^2$, thus indicating that the use of the lubricant provides copy images of further improved quality. However, the use of the lubricant contemplated by the present invention is intended for enlarging the transferable range, in other words, for effectively preventing improper transfer as already described in respect of the mechanism, rather than for the improvement of the transfer efficiency. With the use of the lubricant, the transfer conditions are settable with greater ease as shown in FIG. 4.

EXPERIMENTAL EXAMPLE 3

The second method of pressure transfer was tested, using a pressure roller slightly intersecting the axis of the photoconductive drum as shown in FIG. 6 and driven by the drum. The same pressure roller as used in Experimental Example 1 was used except that the core was not tapered but was in the form of normal cylinder having a diameter of 20 mm. The roller was arranged at varying angles of intersection, $\theta$, of 0.5°, 1.0°, 2.0° and 2.5° to cause the transfer peper to slide laterally in amounts of about 2.6 mm, 5.2 mm, 10.5 mm and 13.1 mm, respectively, per 300-mm length of the paper. The transfer efficiencies attained are shown in Tables 10 to 13, in which the first column shows the angle of intersection, $\theta$, of the pressure roller, the second column shows the amount of sliding (mm) resulting from the intersection, the third column shows the pressure (kg/cm$^2$) applied, the fourth column "A" indicates the heat fixing toner used and "B" the pressure fixing toner, and the fifth column gives the transfer efficiency (%).

TABLE 10

| Angle of inter-section $\theta$ | Amount of sliding | Pressure | Toner | Transfer efficiency |
|---|---|---|---|---|
| 0.5° | 2.6 | 10 | A | 35 |
| | | | B | 55 |
| | | 20 | A | 65 |
| | | | B | 80 |
| | | 30 | A | 80 |
| | | | B | 85 |
| | | 50 | A | 85 |
| | | | B | 85 |

TABLE 11

| Angle of inter-section $\theta$ | Amount of sliding | Pressure | Toner | Transfer efficiency |
|---|---|---|---|---|
| 1.0° | 5.2 | 10 | A | 40 |
| | | | B | 55 |

TABLE 11-continued

| Angle of inter-section $\theta$ | Amount of sliding | Pressure | Toner | Transfer efficiency |
|---|---|---|---|---|
| | | 20 | A | 75 |
| | | | B | 80 |
| | | 30 | A | 85 |
| | | | B | 85 |
| | | 50 | A | 90 |
| | | | B | 90 |

TABLE 12

| Angle of inter-section $\theta$ | Amount of sliding | Pressure | Toner | Transfer efficiency |
|---|---|---|---|---|
| 2.0° | 10.5 | 10 | A | 45 |
| | | | B | 55 |
| | | 20 | A | 75 |
| | | | B | 85 |
| | | 30 | A | 80 |
| | | | B | 85 |
| | | 50 | A | 90 |
| | | | B | 90 |

TABLE 13

| Angle of inter-section $\theta$ | Amount of sliding | Pressure | Toner | Transfer efficiency |
|---|---|---|---|---|
| 2.5° | 13.1 | 10 | A | 40 |
| | | | B | 55 |
| | | 20 | A | 80 |
| | | | B | 80 |
| | | 30 | A | 85 |
| | | | B | 85 |
| | | 50 | A | 85 |
| | | | B | 90 |

The results listed above indicate that if the pressure is less than 20 kg/cm$^2$, the transfer efficiencies attained are less than 75%, but that at pressures not lower than 20 kg/cm$^2$, the transfer efficiencies are all at least 75% except when the toner A is used at a pressure of 20 kg/cm$^2$ as shown in Table 10. These results substantiate that the same outstanding effect as produced by the first method (Experimental Example 1) is achieved by the second method of sliding in which the pressure roller is in an intersecting arrangement. However, at an angle of intersection of 2.5° listed in Table 13, the transfer paper was wrinkled or, in some cases, broken. The angle should therefore be limited to about 2.0° at the largest.

Briefly the present invention provides a method of transferring a toner image from a toner image bearing member onto a transfer material by pressure with use of transfer means, characterized in that sliding is produced between the bearing member and the transfer material to transfer the toner image, so that outstanding copy images are available with exceedingly high efficiency under conditions which are variable over a wider range than heretofore possible. The sliding per se can be effected by a very simple arrangement in the desired amount which is easily settable, while toner images can be transferred at a relatively low pressure. Additionally when a lubricant is applied to the bearing member, more widely varying transfer conditions are settable. This assures a proper transfer operation free of any faults. The present invention therefore has various advantages.

Although the present invention has been fully described by way of example with reference to the accompanying drawings, it is to be noted that various changes and modifications are apparent to those skilled in the art. Therefore unless otherwise such changes and modifications depart from the scope of the invention, they should be construed as being included therein.

What is claimed is:

1. A method of transferring a toner powder image formed on a rotatable drum to an image receiving member by pressure, which comprises pressing a pressure roller against said rotatable drum under a pressure of at least about 20 kg/cm$^2$ and disposing said pressure roller to intersect its rotating axis with the rotating axis of said drum at an angle of about 0.5° to 2° for producing sliding between said rotatable drum and said image receiving member as said image receiving member is transported between said drum and said pressure roller.

2. A method as claimed in claim 1 wherein the toner image on the rotatable drum is formed obliquely in the rotating direction of the drum and said sliding is produced parallelly with respect to the rotating axis of said rotatable drum.

3. A method as claimed in claim 2 wherein the toner image on the rotatable drum is formed obliquely in the rotating direction of the drum by scanning an original in an oblique direction which forms an angle identical to said angle of about 0.5° to 2° relative to an imaginary line perpendicular to the rotating axis of the drum.

4. A method of transferring a toner powder image from a rotatable toner image bearing member to a transfer paper by pressure, which comprises forming the toner image obliquely on said toner image bearing member in the rotating direction thereof; pressing a pressure roller having the circumferential surface of an elastic modulus of at least about 10 kg/mm$^2$ under a pressure of at least about 20 kg/cm$^2$ against said toner image bearing member; and rotating said pressure roller so disposed to intersect its rotating axis with the rotating axis of said toner image bearing member at an angle of about 0.5° to 2° for producing lateral sliding parallel to the rotating axis of said toner image bearing member between said toner image bearing member and said transfer paper as the transfer paper is transported between said toner image bearing member and said pressure roller.

5. An apparatus for transferring a toner powder image to a transfer paper by pressure, which comprises;

a rotatable member onto which a toner image is to be formed;

means for rotating said rotatable member;

means for forming the toner image contracted or enlarged on said rotatable member in the rotating direction thereof;

means for transferring the toner image including a pressure roller having a circumferential surface with an elastic modulus of at least about 10 kg/mm$^2$ and extending parallel to the rotating axis of said rotatable member and in contact with said rotatable member under a pressure of at least about 20 kg/cm$^2$; and means for rotating said pressure roller at a speed faster than the rotating speed of said rotatable member when the contracted toner image is formed and at a speed slower than the rotating speed of said rotatable member when the enlarged image is formed thereby producing sliding between said rotatable member and said transfer paper as the latter is transported between said rotatable member and said pressure roller, the amount of said sliding being about 0.67% to 27% of the length of the transfer paper.

6. An apparatus for transferring a toner powder image to a transfer paper by pressure, which comprises:

a rotatable member onto which a toner image is to be formed;

means for rotating said rotatable member;

means for forming the toner image obliquely on said rotatable member in the rotating direction thereof;

means for transferring the toner image including a pressure roller in contact with the surface of said rotataber under a pressure of at least about 20 kg/cm$^2$ and so disposed to intersect its rotating axis with the rotating axis of said rotatable member at an angle of about 0.5° to 2° for producing lateral sliding parallel to the rotating axis of said rotatable member between said rotatable member and said transfer paper as the latter is transported between said rotatable member and said pressure roller both of which are rotating.

7. An apparatus as claimed in claim 6 wherein said pressure roller has the circumferential surface with an elastic modulus of at least about 10 kg/mm$^2$.

8. An apparatus for transferring a toner powder image to a transfer paper by pressure, which comprises;

a rotatable member onto which a toner image is to be formed;

means for rotating said rotatable member;

means for applying a lubricant to the surface of said rotatable member;

means for forming the toner image contracted or enlarged on said rotatable member in the rotating direction thereof;

means for transferring the toner image including a pressure foller having a circumferential surface with an elastic modulus of at least about 10 kg/mm$^2$ and extending parallel to the rotating axis of said rotatable member and in contact with said rotatable member under a pressure of at least about 20 kg/cm$^2$; and means for rotating said pressure roller at a speed faster than the rotating speed of said rotatable member when the contracted toner image is formed and at a speed slower than the rotating speed of said rotatable member when the enlarged image is formed thereby producing sliding between said rotatable member and said transfer paper as the latter is transported between said rotatable member and said pressure roller, the amount of said sliding being about 0.67% to 27% of the length of the transfer paper.

* * * * *